US011508509B2

(12) United States Patent
Rippel et al.

(10) Patent No.: US 11,508,509 B2
(45) **Date of Patent: *Nov. 22, 2022**

(54) LIQUID COOLED MAGNETIC ELEMENT

(71) Applicant: ENURE, INC., Los Angeles, CA (US)

(72) Inventors: Wally E. Rippel, Altadena, CA (US); Eric E. Rippel, Los Angeles, CA (US)

(73) Assignee: Enure, Inc., Los Angeles, CA (US)

( * ) Notice: Subject to any disclaimer, the term of this patent is extended or adjusted under 35 U.S.C. 154(b) by 45 days.

This patent is subject to a terminal disclaimer.

(21) Appl. No.: 16/194,235

(22) Filed: Nov. 16, 2018

(65) Prior Publication Data

US 2019/0088399 A1 Mar. 21, 2019

Related U.S. Application Data

(63) Continuation-in-part of application No. 15/594,521, filed on May 12, 2017, now Pat. No. 10,600,548.
(Continued)

(51) Int. Cl.
*H01F 27/10* (2006.01)
*H01F 27/12* (2006.01)
(Continued)

(52) U.S. Cl.
CPC ..... *H01F 27/12* (2013.01); *H01F 27/08* (2013.01); *H01F 27/20* (2013.01);
(Continued)

(58) Field of Classification Search
CPC ..... H01F 27/12; H01F 27/08; H01F 27/323; H01F 27/306; H01F 27/2852;
(Continued)

(56) References Cited

U.S. PATENT DOCUMENTS 2,865,086 A 12/1958 Whipple
2,987,684 A 6/1961 Doucette
(Continued)

FOREIGN PATENT DOCUMENTS

CN 101473389 A 7/2009
CN 102265358 A 11/2011
(Continued)

OTHER PUBLICATIONS

International Search Report and Written Opinion of the International Searching Authority, dated Jul. 18, 2017, Corresponding to PCT/US2017/032559, 11 pages.
(Continued)

*Primary Examiner* — Mang Tin Bik Lian
(74) *Attorney, Agent, or Firm* — Lewis Roca Rothgerber Christie LLP

(57) ABSTRACT

A magnetic element. In some embodiments, the magnetic element includes a first electrically conductive coil, having a first annular surface and a second annular surface; a second electrically conductive coil, having a first annular surface and a second annular surface; and a spacer between the first electrically conductive coil and the second electrically conductive coil; a fluid inlet; and a fluid outlet. The spacer may have a first face, the first face being separated from the first annular surface of the first electrically conductive coil by a first gap; and a fluid path may extend from the fluid inlet to the fluid outlet through the first gap.

24 Claims, 15 Drawing Sheets

Related U.S. Application Data

(60) Provisional application No. 62/401,139, filed on Sep. 28, 2016, provisional application No. 62/336,466, filed on May 13, 2016.

(51) Int. Cl.

| | |
|---|---|
| ***H01F 27/20*** | (2006.01) |
| ***H01F 27/28*** | (2006.01) |
| ***H01F 27/08*** | (2006.01) |
| ***H01F 27/32*** | (2006.01) |
| ***H01F 27/30*** | (2006.01) |
| *H01F 27/29* | (2006.01) |

(52) U.S. Cl.
CPC ..... *H01F 27/2852* (2013.01); *H01F 27/2895* (2013.01); *H01F 27/306* (2013.01); *H01F 27/323* (2013.01); *H01F 27/2823* (2013.01); *H01F 27/2847* (2013.01); *H01F 27/29* (2013.01); *H01F 27/303* (2013.01); *H01F 27/322* (2013.01); *H01F 27/324* (2013.01)

(58) Field of Classification Search
CPC .. H01F 27/20; H01F 27/2895; H01F 27/2823; H01F 27/2847; H01F 27/324; H01F 27/29; H01F 27/303; H01F 27/322; H01F 27/10; H01F 27/125; H01F 27/16
See application file for complete search history.

(56) References Cited

U.S. PATENT DOCUMENTS

| | | | | |
|---|---|---|---|---|
| 3,028,566 | A | 4/1962 | Camilli | |
| 4,173,746 | A | 11/1979 | Stubblefield et al. | |
| 4,679,020 | A | 7/1987 | Kawamura et al. | |
| 4,763,072 | A * | 8/1988 | Katoh | G01C 17/28 324/253 |
| 4,847,583 | A | 7/1989 | Bernard | |
| 5,073,734 | A | 12/1991 | Combette | |
| 5,130,687 | A | 7/1992 | Evrard et al. | |
| 5,334,899 | A | 8/1994 | Skybyk | |
| 5,710,466 | A | 1/1998 | Allen et al. | |
| RE36,787 | E | 7/2000 | Hansen et al. | |
| 6,211,595 | B1 | 4/2001 | Nose | |
| 6,273,022 | B1 | 8/2001 | Pu et al. | |
| 6,300,857 | B1 * | 10/2001 | Herwig | H01F 27/2895 336/198 |
| 6,720,688 | B1 | 4/2004 | Schiller | |
| 6,879,237 | B1 * | 4/2005 | Viarouge | H01F 17/043 336/212 |
| 7,710,228 | B2 * | 5/2010 | Feng | H01F 41/122 336/61 |
| 9,496,085 | B2 | 11/2016 | Pal et al. | |
| 9,911,525 | B2 * | 3/2018 | Stelzer | H01F 5/06 |
| 10,600,548 | B2 | 3/2020 | Rippel et al. | |
| 2001/0054383 | A1 | 12/2001 | Pu et al. | |
| 2004/0182517 | A1 | 9/2004 | Lai et al. | |
| 2006/0044104 | A1 | 3/2006 | Derks | |
| 2007/0090916 | A1 * | 4/2007 | Rao | H01F 17/062 336/229 |
| 2009/0140829 | A1 * | 6/2009 | Sodo | H02M 1/126 336/5 |
| 2009/0261933 | A1 | 10/2009 | Kiuchi et al. | |
| 2010/0007225 | A1 | 1/2010 | Platon et al. | |
| 2011/0205007 | A1 | 8/2011 | Kiuchi et al. | |
| 2011/0273256 | A1 * | 11/2011 | Johnson | H01F 30/16 336/170 |
| 2012/0153718 | A1 | 6/2012 | Rawlinson et al. | |
| 2013/0099887 | A1 | 4/2013 | Yamamoto | |
| 2013/0257574 | A1 * | 10/2013 | Downing | H01F 27/10 336/57 |
| 2013/0278369 | A1 * | 10/2013 | Shepard | H01F 27/04 336/58 |
| 2014/0159846 | A1 | 6/2014 | Krämer et al. | |
| 2014/0292456 | A1 | 10/2014 | Suzuki et al. | |
| 2015/0042437 | A1 * | 2/2015 | White | H01F 27/325 336/196 |
| 2015/0097644 | A1 * | 4/2015 | Shepard | H01F 41/0206 336/60 |
| 2015/0213944 | A1 | 7/2015 | Kuroda et al. | |
| 2015/0221430 | A1 | 8/2015 | Wu Li | |
| 2015/0228399 | A1 * | 8/2015 | Yoshimori | H01F 27/28 336/170 |
| 2016/0005521 | A1 * | 1/2016 | Pal | H01F 27/08 336/60 |
| 2016/0181000 | A1 * | 6/2016 | Yen | H01F 27/2895 336/220 |
| 2017/0110238 | A1 | 4/2017 | Daily et al. | |
| 2017/0330670 | A1 | 11/2017 | Rippel et al. | |
| 2018/0157279 | A1 | 6/2018 | Ganowsky et al. | |
| 2020/0082968 | A1 | 3/2020 | Rippel et al. | |

FOREIGN PATENT DOCUMENTS

| | | | |
|---|---|---|---|
| CN | 103578715 | A | 2/2014 |
| CN | 104603893 | A | 5/2015 |
| CN | 105103409 | A | 11/2015 |
| CN | 106662408 | A | 5/2017 |
| CN | 109155180 | A | 1/2019 |
| JP | 59-46015 | A | 3/1984 |
| JP | 60-33082 | A | 2/1985 |
| JP | 6-251956 | A | 9/1994 |
| JP | 2004-55802 | A | 2/2004 |
| KR | 10-2013-0111922 | A | 10/2013 |

OTHER PUBLICATIONS

International Search Report and Written Opinion of the International Searching Authority, dated Sep. 13, 2018, Corresponding to PCT/US2018/040059, 10 pages.
U.S. Appl. No. 16/022,463, filed Jun. 28, 2018.
Chinese Notification of the First Office Action, for Patent Application No. 201780029677.X, dated Jan. 3, 2020, 8 pages.
Japanese Notification of Reasons for Rejection, for Patent Application No. JP 2018-559702, dated Oct. 29, 2019, 6 pages.
Partial English translation of the Chinese Notification of the First Office Action, for Patent Application No. 201780029677.X, dated Jan. 3, 2020, 11 pages.
Partial English translation of the Japanese Notification of Reasons for Rejection, for Patent Application No. JP 2018-559702, dated Oct. 29, 2019, 13 pages.
U.S. Office Action from U.S. Appl. No. 15/594,521, dated Mar. 5, 2019, 15 pages.
Chinese Notification of the Second Office Action, for Patent Application No. 201780029677.X, dated Oct. 29, 2020, 3 pages.
Partial English translation of the Chinese Notification of the Second Office Action, for Patent Application No. 201780029677.X, dated Oct. 29, 2020, 6 pages.
Chinese Notification of the Third Office Action, for Patent Application No. 201780029677.X, dated Jul. 28, 2021, 13 pages.
Partial English translation of the Chinese Notification of the Third Office Action, for Patent Application No. 201780029677.X, dated Jul. 28, 2021, 22 pages.
U.S. Office Action from U.S. Appl. No. 16/022,463, dated Mar. 11, 2021, 68 pages.
Chinese Notification of the First Office Action, for Patent Application No. 201880043770.0, dated May 7, 2022, 7 pages.
Partial English translation of the Chinese Notification of the First Office Action, for Patent Application No. 201880043770.0, dated May 7, 2022, 11 pages.

* cited by examiner

LIQUID COOLED MAGNETIC ELEMENT

CROSS-REFERENCE TO RELATED APPLICATION(S)

The present application is a continuation-in-part of U.S. patent application Ser. No. 15/594,521, filed May 12, 2017, which claims the benefit of U.S. Provisional Application No. 62/336,466, filed May 13, 2016, and which claims the benefit of U.S. Provisional Application No. 62/401,139, filed Sep. 28, 2016. The entire contents of all of the documents identified in this paragraph are incorporated herein by reference.

FIELD

One or more aspects of embodiments according to the present invention relate to magnetic elements, and more particularly to a fluid-cooled toroidal magnetic element.

BACKGROUND

Magnetic elements such as transformers and inductors serve important functions in various power processing systems. In order to minimize their size and cost, current densities and electrical frequencies may be made as high as possible. In such a system, it may be advantageous to arrange for efficient heat transfer from the winding and core and also for low eddy losses—both within the winding and the core. Magnetic elements having a toroidal geometry may have various advantages, but their fabrication may involve the use of special winding equipment, and fabricating high current windings may be challenging.

Thus, there is a need for an improved design for a magnetic element.

SUMMARY

Aspects of embodiments of the present disclosure are directed toward a toroidal magnetic element. A plurality of coils is arranged in a toroidal configuration. Each coil may be a hollow cylinder, formed by winding a rectangular wire into a roll. The coils alternate with spacers, each of which may be a wedge. The coils may be arranged in pairs which interconnect at the I.D. Small gaps are formed between the coils and the wedges, e.g. as a result of each wedge having, on its two faces, a plurality of raised ribs, against which the coils abut. Cooling fluid flows through the gaps to cool the coils.

According to an embodiment of the present invention there is provided a magnetic element, including: a first electrically conductive coil, having a first annular surface and a second annular surface; a first electrically insulating spacer having a first flat face and a second flat face, the first flat face being separated from the first annular surface by a first gap; a fluid inlet; and a fluid outlet, wherein a fluid path extends from the fluid inlet to the fluid outlet through the first gap.

In one embodiment, the first coil is a hollow cylindrical coil, and the first electrically insulating spacer is a first wedge.

In one embodiment, the magnetic element includes a second hollow cylindrical coil, the second coil having a first annular surface forming a second gap with the second flat face of the first wedge.

In one embodiment, the first coil has an outer end and an inner end, and the second coil has an outer end and an inner end connected to the inner end of the first coil, and wherein a contribution to a magnetic field at the center of the first coil, from a current flowing through both coils in series, is in the same direction as a contribution to the magnetic field from the current flowing through the second coil.

In one embodiment, the magnetic element includes a plurality of pairs of coils including the first coil and the second coil, each coil having an inner end and an outer end, the inner ends of each pair being connected together, the coils being arranged to form a torus.

In one embodiment, the magnetic element includes: a plurality of active wedges including the first wedge; and a plurality of passive wedges, each of the active wedges having two flat faces and being between the two coils of a respective pair of coils, one coil of the pair of coils being on one of the flat faces, and the other coil of the pair of coils being on the other flat face, and each of the passive wedges being between a coil of one pair of coils and a coil of another pair of coils.

In one embodiment, a ducted wedge of the plurality of active wedges and the plurality of passive wedges has a fluid passage extending from outside the torus to an inner volume of the torus.

In one embodiment, the magnetic element includes a plurality of core segments, in an inner volume of the torus.

In one embodiment, a core segment, of the plurality of core segments, is ferromagnetic.

In one embodiment, the fluid path further extends through a third gap, the third gap being a radial gap between the core segment and the first coil and/or the first wedge.

In one embodiment, each of the core segments has a hole extending toroidally through the core segment, and wherein the fluid path further extends through one of the holes and through a toroidal gap between two adjacent core segments of the plurality of core segments.

According to an embodiment of the present invention there is provided a toroidal magnetic element, including: a plurality of electrically conductive coils arranged to form a torus; and a plurality of electrically insulating spacers, each of the spacers being between two adjacent coils of the plurality of coils, each of the plurality of coils including a face-wound electrical conductor and having a first inner end and a first outer end.

In one embodiment, the respective winding orientations of the coils alternate around at least a portion of the torus; and the first inner end of each of the plurality of coils is connected to the first inner end of a respective adjacent coil of the plurality of coils.

In one embodiment, the toroidal magnetic element includes n co-wound conductors and having n inner ends including the first inner end and n outer ends including the first outer end, and wherein a $j^{th}$ inner end of a coil of the plurality of coils is connected to an $(n-j+1)^{th}$ inner end of a respective adjacent coil of the plurality of coils.

In one embodiment, each of the coils is a hollow cylinder having two parallel annular surfaces.

In one embodiment, each of the spacers is a wedge having two flat faces.

In one embodiment, each annular surface of each of the coils is separated from an adjacent face of an adjacent wedge by a gap.

In one embodiment, the toroidal magnetic element includes a housing containing the torus, the housing having a fluid inlet and a fluid outlet, a fluid path from the fluid inlet to the fluid outlet including a portion within one of the gaps.

In one embodiment, an outer end of a first coil of the plurality of coils is connected to an outer end of a second coil of the plurality of coils by a first bus bar.

In one embodiment, the toroidal magnetic element includes: a first terminal; a second terminal; and a third terminal; and including: a first winding having a first end connected to the first terminal and a second end connected to the second terminal, and including a first coil of the plurality of coils and a second coil of the plurality of coils, the first coil and the second coil being connected in series; and a second winding having a first end connected to the third terminal and a second end, and including a third coil of the plurality of coils and a fourth coil of the plurality of coils, the third coil and the fourth coil being connected in series.

According to an embodiment of the present invention there is provided a fluid-cooled toroidal magnetic element, including: a plurality of electrically conductive coils arranged to form a torus; a plurality of electrically insulating spacers; a fluid inlet; and a fluid outlet, each of the spacers being between two adjacent coils of the plurality of coils, each of the coils including a face-wound electrical conductor, each of the coils having two annular surfaces, each annular surface of each of the coils being separated from an adjacent face of an adjacent spacer by a gap, wherein a respective fluid path extends from the fluid inlet to the fluid outlet through each of the gaps.

In one embodiment, each of the gaps has a width greater than 0.001 inches and less than 0.02 inches.

BRIEF DESCRIPTION OF THE DRAWINGS

These and other features and advantages of the present invention will be appreciated and understood with reference to the specification, claims, and appended drawings wherein:

DETAILED DESCRIPTION

The detailed description set forth below in connection with the appended drawings is intended as a description of exemplary embodiments of a liquid cooled magnetic element provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1A:
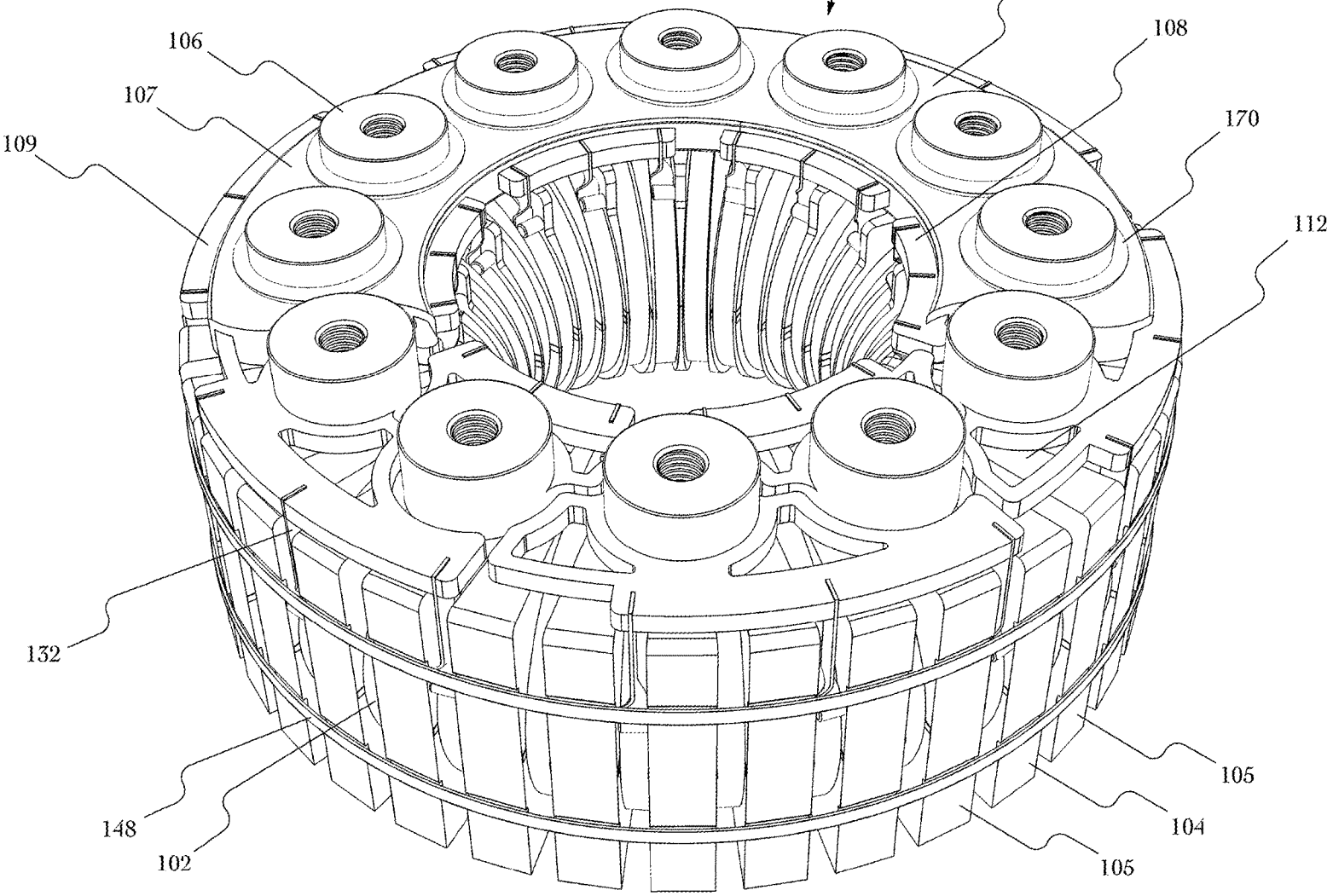
FIG. 1*a* is a partial cut-away perspective view of a toroidal assembly, according to an embodiment of the present invention.

In some embodiments a liquid cooled toroidal magnetic element includes a toroidal assembly 101, illustrated in FIG. 1*a*, in a housing (FIG. 7; omitted from FIG. 1*a* for clarity) of a liquid cooled magnetic element according to one embodiment. In some embodiments the toroidal assembly 101 includes an alternating set of coils 102 and wedges 104, 105 in a configuration having an approximately toroidal shape. The wedges 104, 105 may act as insulating spacers to insulate the coils from each other and to position and align the coils 102 into a toroidal configuration. Connections to the coils 102 are made using terminals 106, at the top of the toroidal magnetic element, each of which may be connected to one or more of the coils 102 through respective bus bars 108, 109.

An over-mold 110, composed of an electrically insulating material, secures the terminals 106 together. Each of the bus bars 108, 109 includes one or more bus bar holes 112 through which the over-mold 110 is molded, so that the over-mold 110 is mechanically locked to the bus bars 108, 109 and the bus bars 108, 109 reinforce the over-mold 110. The subassembly consisting of the terminals 106, the bus bars 108, 109, and the over-mold 110 may be separately fabricated, e.g., by securing the terminals 106 and the bus bars 108, 109 in a suitable mold, and molding the over-mold 110 around the terminals 106 and the bus bars 108, 109 and through the holes 112 in the bus bars 108, 109. The molding of the over-mold may be performed, for example, by injection molding, or by casting, using a thermosetting resin that is cured in the mold. The over-mold 110 may be composed of an insulating material, e.g., one that can withstand the temperature it may be exposed to when the outer ends 132 (FIG. 1*a*) of the coils 102 are soldered to the bus bars 108, 109. For example, the over-mold 110 may be composed of polyether ether ketone (PEEK). FIG. 1*a* shows an embodiment with twelve terminals 106, thirty-six coils 102, and thirty-six wedges 104, 105; in other embodiments there may be more or fewer of some or all of these components.

Figure 1B:
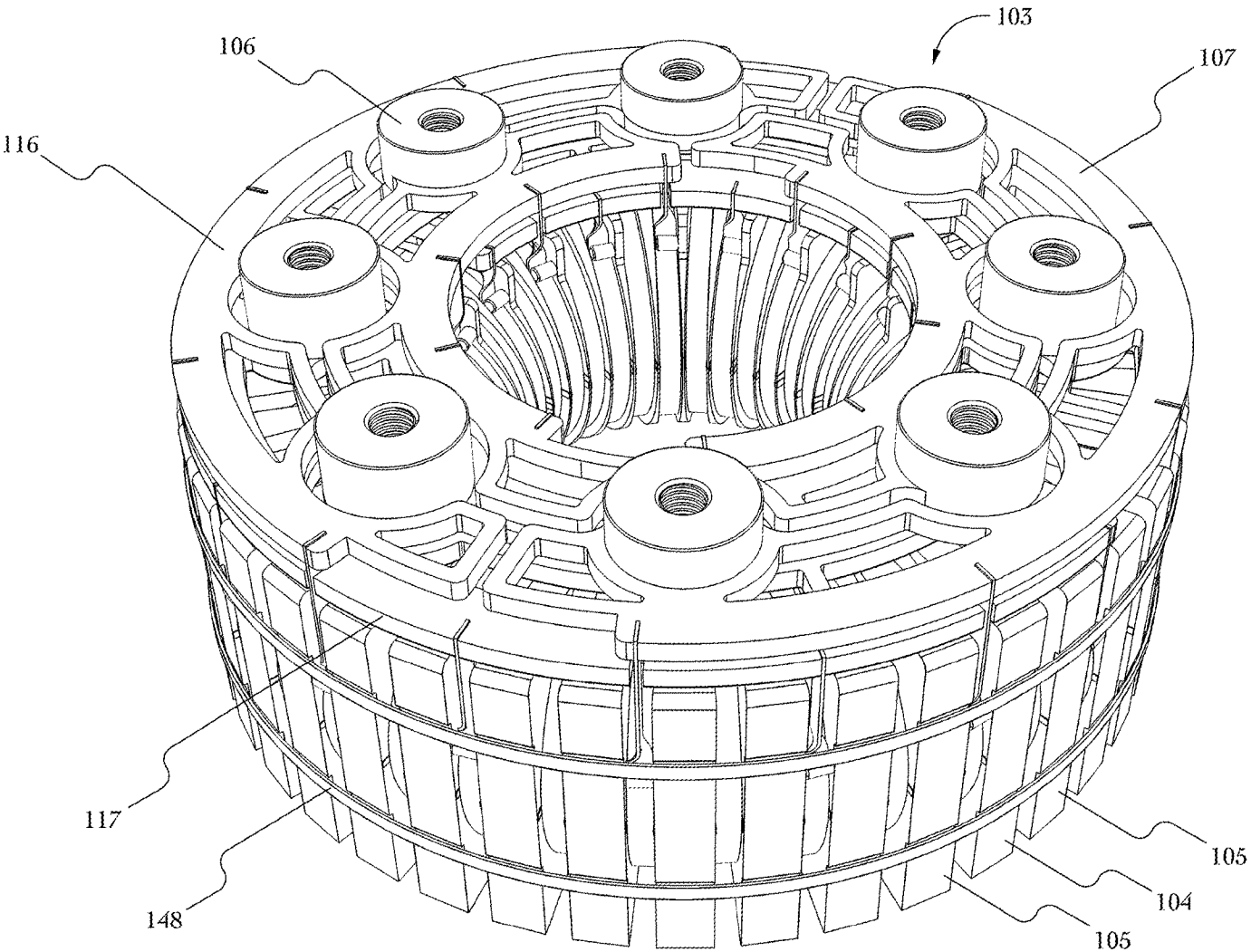
FIG. 1*b* is a partial cut-away perspective view of a toroidal assembly, according to an embodiment of the present invention.
Figure 1C:
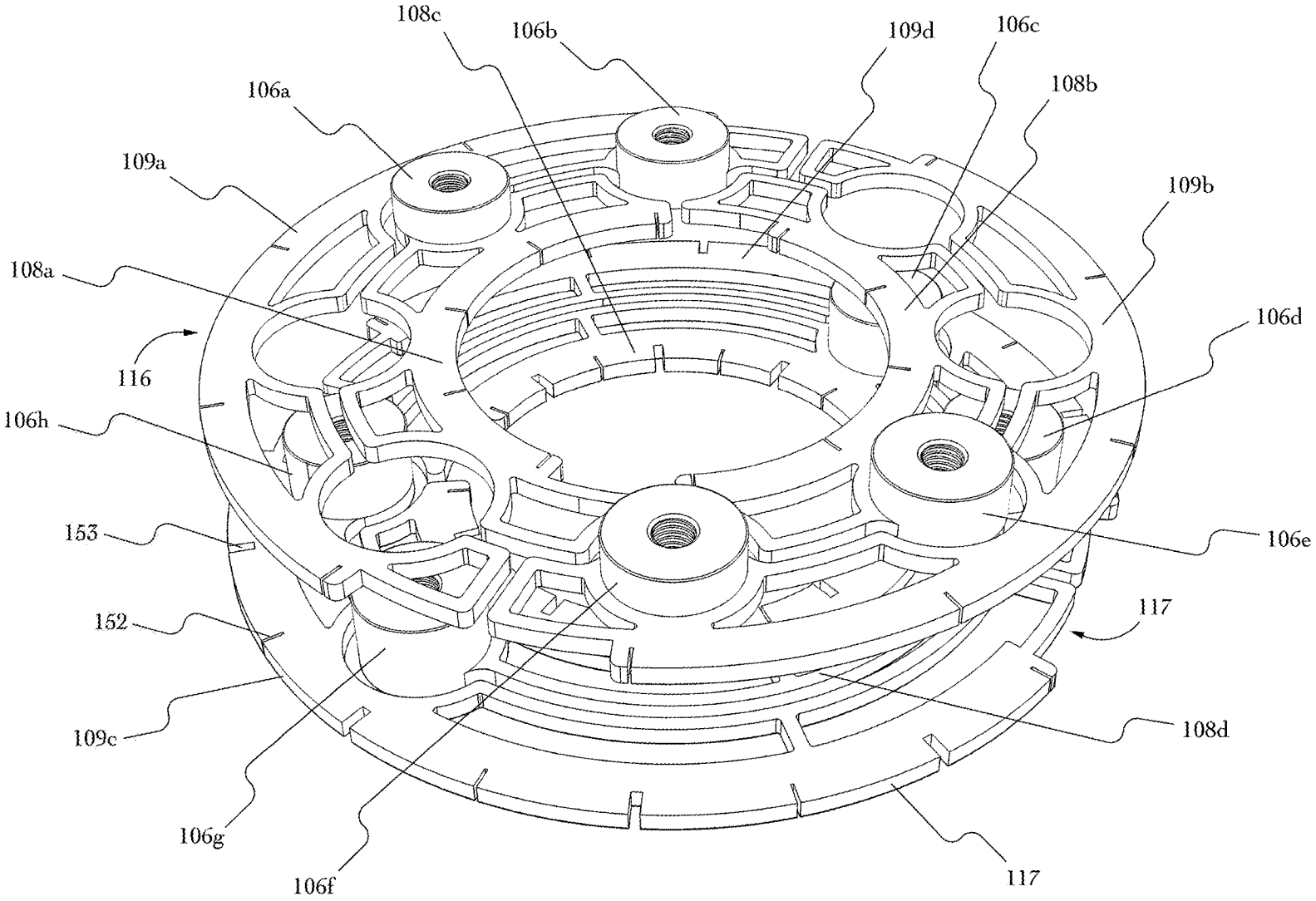
FIG. 1*c* is a exploded perspective view of a terminal busbar assembly, according to an embodiment of the present invention.
Figure 2:
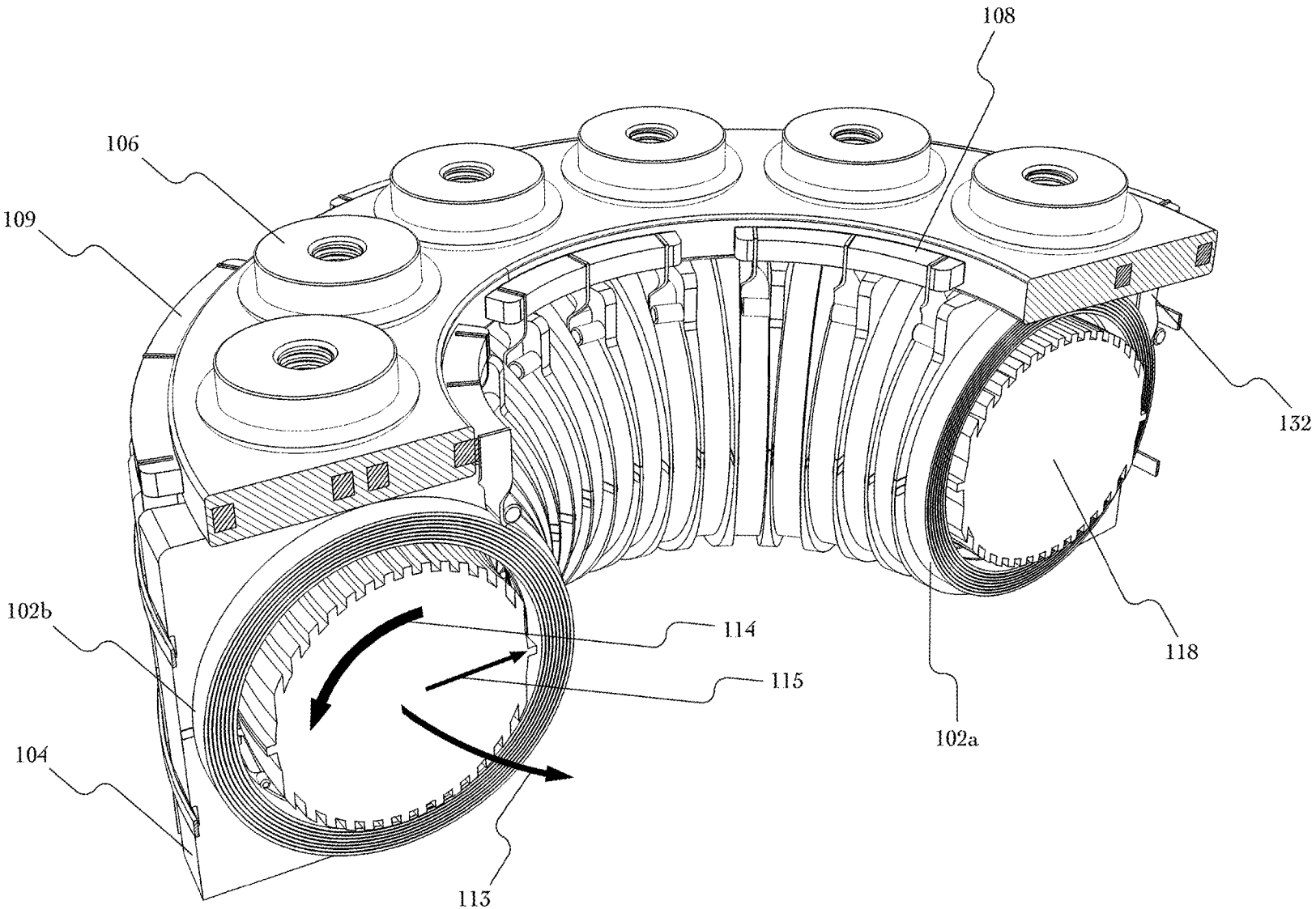
FIG. 2 is a partial cut-away perspective view of a portion of a toroidal assembly, according to an embodiment of the present invention.

Referring to FIGS. 1*b* and 1*c*, in some embodiments, terminal board 107 comprises one or more layers each consisting of one or more mutually insulated conductors. In FIG. 1*b* a two layer terminal board is shown where the lower layer is composed of four conductive plates 108*c*, 108*d*, 109*c*, 109*d* and the upper layer is composed of four conductive plates 108*a*, 108*b*, 109*a*, 109*b*. Each conductive plate is contiguous with a respective terminal post 106 (e.g., one of terminal posts 106*a* through 106*h*) such that complete electrical nodes are formed. Individual conductors (each including, e.g., a conductive plate and a terminal post) are mutually insulated and mechanically supported by an over-mold (e.g., a resin over-mold; not shown in FIGS. 1*b* and 1*c* but visible, e.g., in FIG. 1*a*). Additional insulating elements may also be included to insure that electrical breakdown does not occur when high voltages are applied to the conductors. Each terminal post 106 may include a female thread as shown, or may include a threaded stud, such that lugged cables can be terminated. As shown, terminal board 107 comprises top conductive layer 116 and bottom conductive layer 117 which are axially separated from one another by a gap. In turn, top conductive layer 116 comprises two radially outward extending bus bars 109*a* and 109*b* and two radially inward extending bus bars 108*a* and 108*b*, where each bus connects to a respective terminal 106. Likewise, bottom conductive layer 117 comprises two radially outward extending bus bars 109*c* and 109*d* and two radially inward extending bus bars 108*c* and 1089, where each bus connects to a respective terminal 106. Radial bus extensions extend out of the insulating over mold and which in turn connect to winding ends such that the desired terminal function is achieved. Bottom conductive layer 117 includes peripheral slots 152 which terminate coil ends. Slots 153 are added to provide clearance for conductors which connect to top layer 116. The terminal board concept can have many variations. For example, any number of layers may be used; each layer may contain any number of conductors; individual layers may differ from each other; or terminal post sizes may differ from each other; multiple terminals may be used for a single conductor;

FIG. 2 shows a portion of the toroidal assembly 101 illustrated in FIG. 1. Also shown are arrows defining a toroidal coordinate system used herein to identify positions and direction in the structure. A first arrow 113 points in a toroidal direction, a second arrow 114 points in a poloidal direction, and a third arrow 115 points in a radial direction. In operation, current flows in a substantially poloidal direction in each coil 102, forming a magnetic field, inside the coils 102, in a substantially toroidal direction. As discussed in further detail below, the coils 102 are arranged to alternate between two different coil winding orientations, a first winding orientation, and a second winding orientation. In a coil 102 having the first winding orientation, current flows along a spiral path progressing radially outward when it flows in the positive poloidal direction (as is the case for the coil 102*a* of FIG. 2), and in a coil 102 having the second winding orientation, current flows along a spiral path progressing radially inward when it flows in the positive poloidal direction (as is the case for the coil 102*b* of FIG. 2). The coils 102 are connected in series pairwise, with each coil 102 having an inner end connected to the inner end of an adjacent coil. As a result of the alternating winding orientation of the coils 102 the contribution from one coil 102 of any such pair will be in the same direction, along the axis of the two coils 102, as the contribution from the other coil 102 of the pair, when current flows in series through the two coils 102 of the pair.

Core segments 118 are arranged to form a composite core in an approximately toroidal shape inside the coils. As used herein, a "coil" is a conductive element having one or more turns of a conductor (e.g., a wire), and extending (e.g., in a spiral) from an inner end to an outer end of the conductor. A "winding", as used herein, is a conductive element including one or more coils, and having two ends connected to two respective terminals. For example, as described in further detail below, a winding may consist of two coils having their respective inner ends connected together, their respective outer ends being the two ends of the winding and being connected to two respective terminals. A "composite winding", as used herein, is a two-terminal element that is a series and/or parallel combination of one or more windings. A "composite coil", as used herein, is a conductive element including two or more co-wound conductors, each extending (e.g., in a spiral) from a respective inner end to a respective outer end of the respective conductor. As used herein, when two respective terminals of two coils are described as being "connected" it means that they are directly connected, with no intervening elements, or that they are connected with one or more intervening elements (e.g., short conductors) that do not qualitatively change the characteristics of the element.

As discussed in further detail below, each of the terminals 106 of FIGS. 1*a* and 2 may be connected to a composite winding consisting of three windings connected in parallel, each winding consisting of two coils connected in series. As such, the toroidal assembly 101 consists of six composite windings, which may be configured, by making suitable connection to the terminals, to be a transformer or an inductor. For example, a suitable parallel or series combination of the composite windings may act as an inductor. By connecting a first subset of the composite windings in a first parallel or series combination and connecting a second subset of the composite windings (e.g., the remainder of the composite windings) in a second parallel or series combination, a transformer may be formed. The core of a transformer may be different from the core of an otherwise similar inductor. For transformers, core permeability may be high while gaps between segments are minimized so that magnetizing currents are minimized. With inductors, either core material may be low permeability, or finite gaps may be established (or both) such that core saturation is prevented. In some cases, both inductance and transformer action are present, as in the case of a "flyback transformer". In all such cases, embodiments of the present invention allow windings to be connected and interconnected as desired. The leakage inductance of the transformer may be adjusted by, e.g., selecting alternating composite windings for use in the first subset (to reduce the leakage inductance) or selecting consecutive composite windings for use in the first subset (to increase the leakage inductance).

Cooling fluid (or "coolant") may flow between and around the coils and the core to extract heat. In some embodiments the coolant is a liquid, e.g., oil or transmission fluid. In other embodiments, it is a gas, e.g., air. As used herein, "fluid" refers to either a liquid or a gas, unless otherwise specified. Each coil 102 is formed of face-wound rectangular wire (i.e., wound in the manner of a roll of tape) that has an inner end and an outer end 132. The wire may have a width of about 0.16 inches (e.g., a width of 0.163 inches) and a thickness of about 0.020 inches (e.g., a thickness of 0.023 inches). The inner end of coil 102*a* is contiguous with the inner end of coil 102*b*. An "S-Bend" maybe needed to accommodate the fact that the two coils are in separate planes. The outer end 132 of each coil 102 may have a 90-degree axial twist. Strain relief is provided by a strain relief post 134 which may be included in each active wedge 104.

Each coil 102 may be separately fabricated. The rectangular wire may be coated, before being wound into a coil, with a coating of self-bonding insulation directly on the wire or on a layer of insulation that is on the wire. The total insulation thickness on the wire may be, e.g., 0.002 inches. The coil may be formed by winding the wire around a suitable mandrel, and driving current through the wire (e.g., for 30 seconds) to heat the wire and the self-bonding insulation so that adjacent turns are bonded together and the coil becomes, except for outer ends 132, a rigid hollow cylindrical unit.

Figure 3:
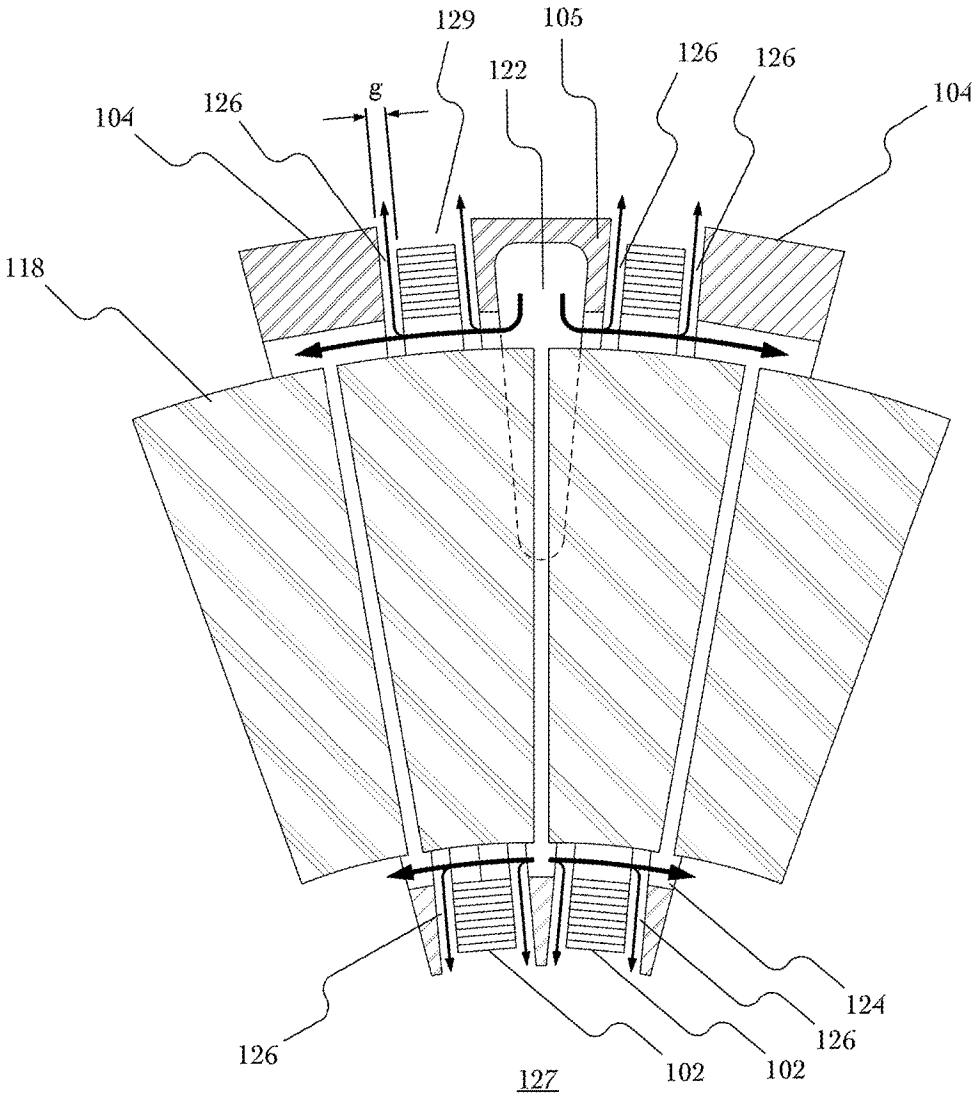
FIG. 3 is a cross sectional view of a portion of a toroidal assembly, according to an embodiment of the present invention.

FIG. 3 shows an enlarged top view of a portion of the fluid-cooled magnetic element including four core segments 118, two coils 102, and two active wedges 104, one passive wedge 105. Coolant flows in the directions indicated by the arrows, flowing into the structure (from a coolant inlet 174 and through an inlet hole 175 in the housing (FIG. 7) through an inlet passage 122 in the central wedge 105 of the three wedges, toroidally and poloidally within a first radial gap 124, and radially outward through a plurality of toroidal gaps 126. Each of the toroidal gaps 126 may have a width g (e.g., 0.004 inches), as illustrated in FIG. 3. From any one of the toroidal gaps 126, the fluid may flow directly into the center 127 of the toroidal assembly 101 (if the fluid exits the toroidal gap 126 at a poloidal coordinate near the center 127 of the toroidal assembly 101), or it may flow in a poloidal direction through one of a plurality of second radial gaps 129 (each being a gap between the outer surface of a coil 102 and the inner surface of the housing (FIG. 7)), and into the center 127 of the toroidal assembly 101. The first and second radial gaps may each have a radial dimension of about 0.05 inches, which may be significantly greater than g. As such, the first radial gap 124 may act as an inlet manifold, and second radial gaps and the center 127 of the toroidal assembly 101 may act as an outlet manifold, for the fluid flow through the plurality of toroidal gaps 126, ensuring substantially equal pressure drop across, and along the poloidal extent of, each of the toroidal gaps 126.

Fluid flow within the first radial gap 124 may provide cooling of the core segments 118. Moreover, a pressure gradient within the gaps between the core segments 118 (the pressure being generally lower nearer the center of the toroidal assembly 101) may cause fluid to flow through these gaps to provide additional cooling of the core segments 118. In some embodiments the core is composed of core segments each having a toroidal through hole so that the core is hollow, and one of the core segments has an inlet hole aligned with the inlet passage 122 (which may have a suitable altered shape), so that coolant flows first into and toroidally within the hollow interior of the core, and then through toroidal gaps between the core segments 118 into the first radial gap 124. As a result the core may be cooled both by coolant flow through the hollow center of the core and by coolant flow through the toroidal gaps between the core segments 118. In some embodiments, the wedge 104, 105 containing the inlet passage 122 has a ridge or similar feature (or a sealant is applied between the wedge and the core segment having the inlet hole) forming a dam to prevent coolant from escaping from the inlet passage directly into the first radial gap 124.

Heat transfer between the coils 102 and the coolant may occur primarily within the toroidal gaps 126. The dimensions of these gaps, and the coolant flow rate, may be selected using a heat transfer analysis, which may proceed as follows. If the flow of a fluid (e.g., oil) in a gap between parallel surfaces (each surface having an area A, the surfaces being separated by distance d) is laminar (i.e., if the viscosity, flow rate, and the width of the gap result in laminar flow), heat transfer may be characterized by a thermal resistance ($\theta$) which, in turn, is the sum of two terms. The first term ($\theta_1$) is associated with the thermal mass and flow rate of the liquid and is equal to $1/(C_p\rho F)$, where $C_p$ is the specific heat, $\rho$ is the mass density, and F is the volumetric flow rate. The second term ($\theta_2$) is associated with the thermal conductivity of the liquid.

If heat flows out of one of the two surfaces at a rate of $P_d$, and no heat flows out of the other surface, then the average heat flow distance within the coolant (neglecting temperature gradients within the fluid) is d/2 and hence the value of $\theta_2$ is d/(2KA), where K is the thermal conductivity of the coolant. If heat flows out of each of the two surfaces at a rate of $P_d/2$, then the average heat flow distance is d/4, and the value of $\theta_2$ in this case is d/(8KA). In either case, as d is reduced and A increased, $\theta_2$ is reduced, enabling improved heat transfer. However, as d is reduced, the coolant head loss increases. Accordingly, there exists a value of d at which the heat transfer rate is greatest, based on the flow versus pressure characteristic provided by the coolant circulation pump.

The above relations may be exploited in the case of heat transfer from a winding. For example, in the embodiment illustrated in FIG. 3, fluid flowing in each of the toroidal gaps 126 may exhibit laminar flow, and heat may flow out of the substantially flat annular end surface at each end of each of the coils 102, into fluid flowing through a respective toroidal gap 126. The other surface of each of the toroidal gaps 126 may be a surface of a wedge, out of which heat does not flow. The total surface area through which heat flows from the coils 102 to coolant is proportionate to the number of coils 102, and may be large. The width of the toroidal gaps 126 may be selected so that the sum of $\theta_1$ and $\theta_2$ is minimized for a given pump flow characteristic. As the number of windings is increased, the effective winding packing factor is reduced, and heat dissipation (for fixed power density) may increase. Accordingly, there may be a number of coils for which the achievable power density is greatest.

A magnetic element such as that illustrated in FIG. 1*a* may be employed, for example, as an inductor, or as a transformer. In a transformer, a high permeability core may be used to maintain low magnetizing currents. In a power inductor, magnetizing current may be the objective, and transformer action may not be present. Accordingly, useful core configurations for inductors may include gapped high permeability lamination structures, gapped ferrite structures, non-gapped low permeability powder cores, and air-core structures. To form a powder core, the powder may be bonded, in a process similar to a sintering process, to become a rigid solid.

In the case of gapped lamination cores, the size of the gap is proportionate to the number of ampere-turns, which in turn is proportionate to the square of a linear dimension times the current density. The achievable current density increases as heat transfer is improved, and in large inductors which have good heat transfer, the gap size may become unreasonably large. In such cases, either a powder core or an air core may be used. Toroidal core structures may have advantages for both transformers and inductors. One is that leakage fields are small, especially in air-core magnetic elements, due to symmetry; this characteristic may be important where high currents are involved and where there is sensitivity to radiated fields. A toroidal geometry may also provide advantages in terms of power to mass and power to volume ratios. Finally, the symmetry of a toroidal structure allows multiple windings to be interconnected without incurring circulating currents. For magnetic elements with a magnetic core (i.e., a core that is not an air core), power dissipation (e.g., due to eddy currents) in the core may be significant, and provisions may be made to cool the core, as described above, for example.

Power may be dissipated in the windings by several mechanisms. In addition to DC resistance losses, skin and proximity losses may become increasingly important as the current and/or the frequency is increased. Skin loss is a phenomenon that results in reduced current density toward the center of the conductor and is due to the fact that the rate at which the B field enters a conductor is limited by the electrical conductivity of the conductor; the lower the conductivity, the faster the B field can enter and the less pronounced the effect. Hence, the best conductors (such as copper) have the most pronounced skin effect. The impact of the skin effect may be reduced by using multiple conductors connected in parallel. In such a multiple-conductor configuration, inner and outer conductors may be transposed, so that induced voltages average out and the circulating currents disappear, with the result that currents are nearly uniform. The multiple conductors may be symmetrically arranged such that induced voltages accurately match, lest circulating currents between the individual conductors result. The proximity effect is a phenomenon that results in circulating currents and losses when magnetic fields produced by external conductors enter a given conductor, inducing the circulating currents which in turn incur the losses within the given conductor. For round conductors, the magnitude of these losses is proportionate to the square of the magnetic field times the fourth power of the conductor diameter. As such, for large structures, such as inductors, this loss component, like the skin loss component, may be reduced by using multiple conductors or multiple windings connected in parallel.

Figure 4A:
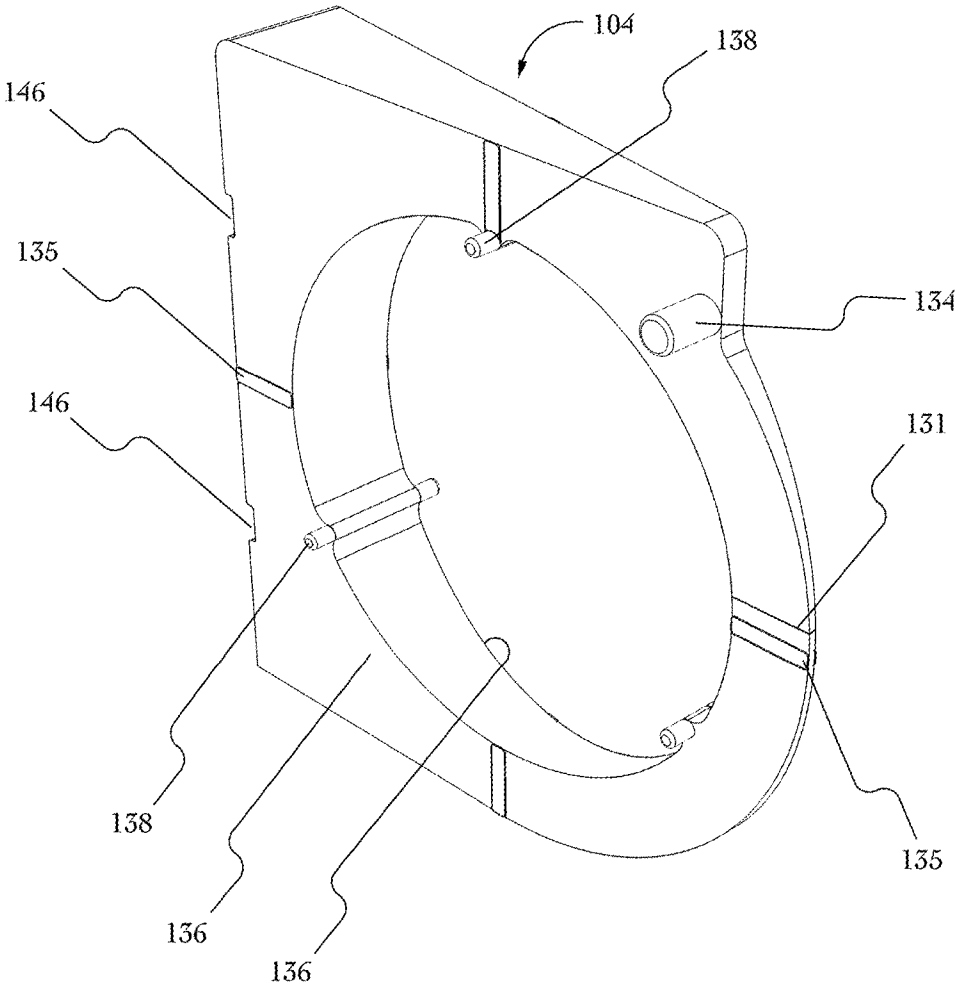
FIG. 4*a* is a perspective view of an active wedge of a toroidal assembly, according to an embodiment of the present invention.
Figure 4B:
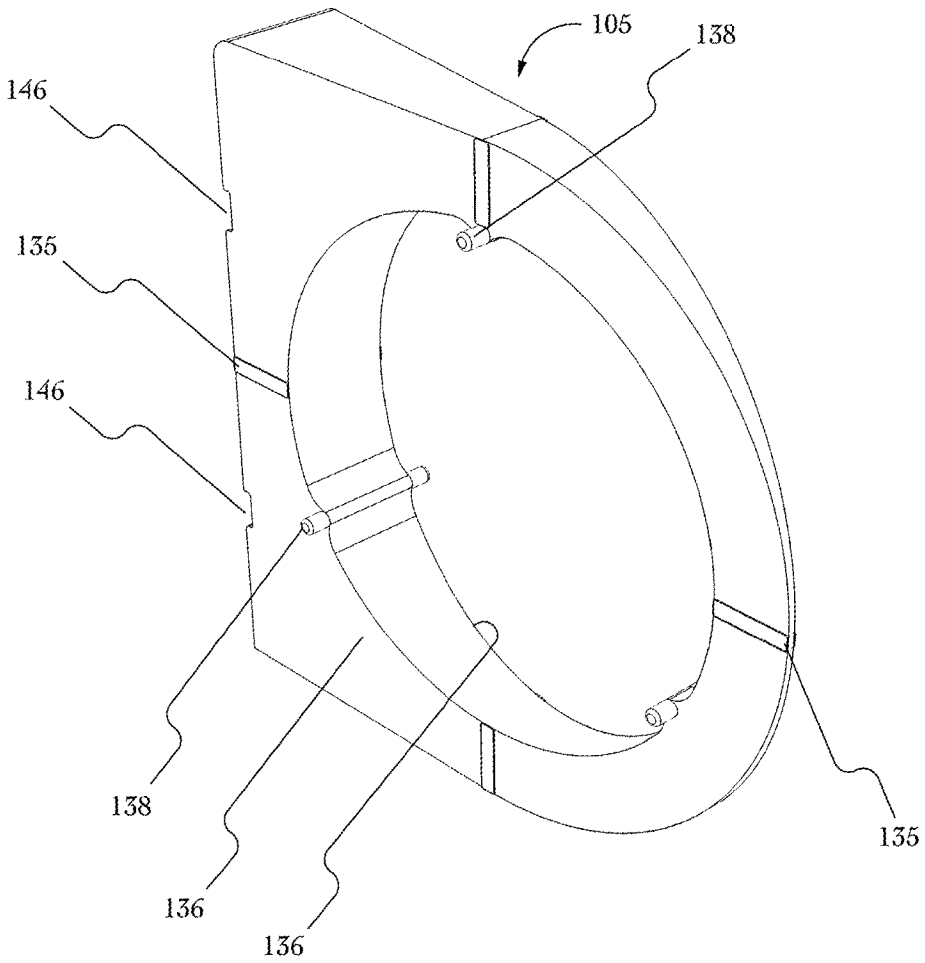
FIG. 4*b* is a perspective view of a passive wedge of a toroidal assembly, according to an embodiment of the present invention.

Each of the wedges 104, 105 may be either an active wedge 104 (FIG. 4*a*) or a passive wedge 105 (FIG. 4*b*). For either or both wedge types, strain relief post 134 serves to constrain coil outer ends 132. For each active wedge 105, slit 131 is added such that the conductor of coils 102 can be inserted within the wedge bore Each wedge may be composed of an insulating material, e.g., PEEK or a thermoset. In other embodiments a different material capable of withstanding the cooling fluid, e.g., transformer oil, which may be at high temperature during operation, is employed. Examples of candidate materials include nylon, polyphenylene oxide (PPO), and polyphenylene sulfide (PPS).

Referring to FIG. 4*b*, the remaining wedges in the liquid cooled magnetic element may be passive wedges 105. In the toroidal assembly 101, passive wedges 105 may alternate with active wedges 104. Each active wedge 104 may be sandwiched between a pair of coils 102 that are connected to each other at their respective inner ends by an "S-Bend". In some embodiments, for ease of manufacturing, all of the wedges have the same shape, and some features of some of the wedges may be unused.

Figure 4C:
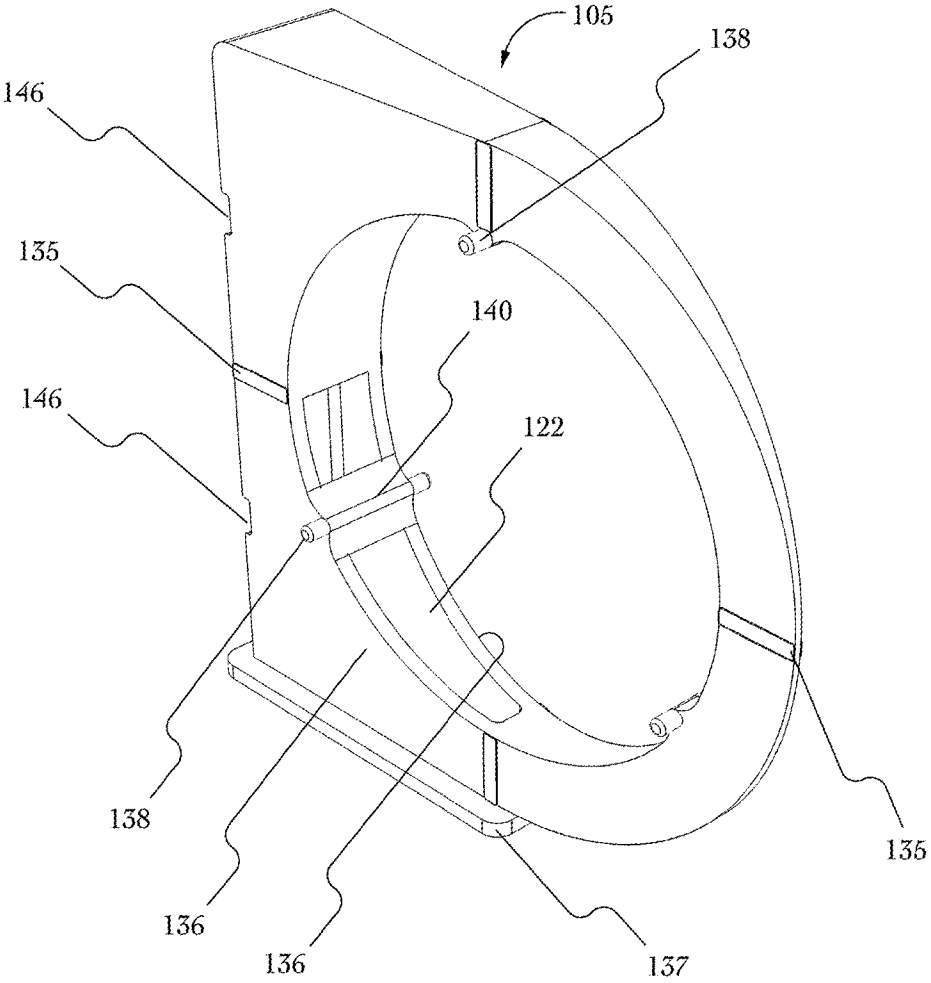
FIG. 4*c* is a perspective view of a ducted wedge of a toroidal assembly, according to an embodiment of the present invention.
Figure 4D:
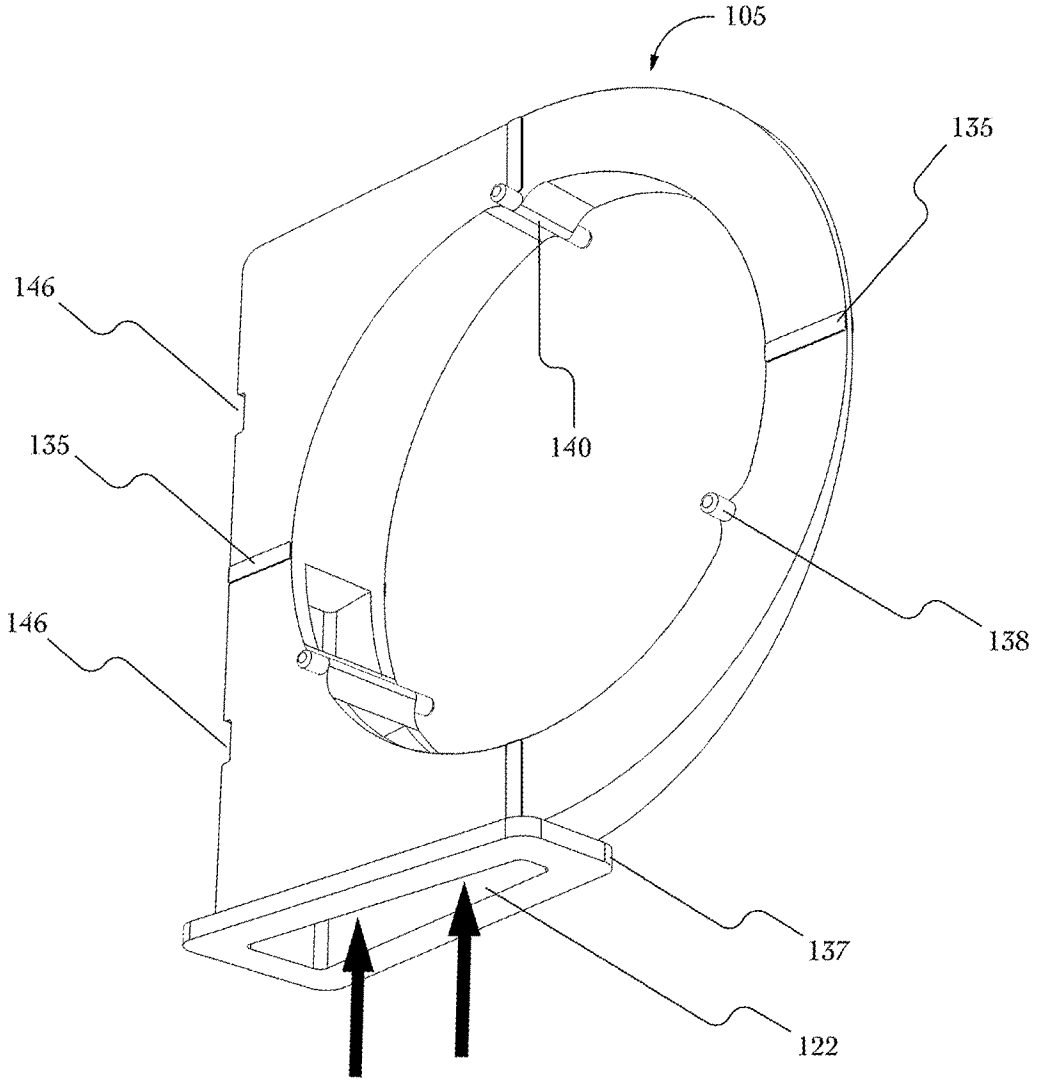
FIG. 4*d* is a perspective view of a ducted wedge of a toroidal assembly, according to an embodiment of the present invention.
Figure 4E:
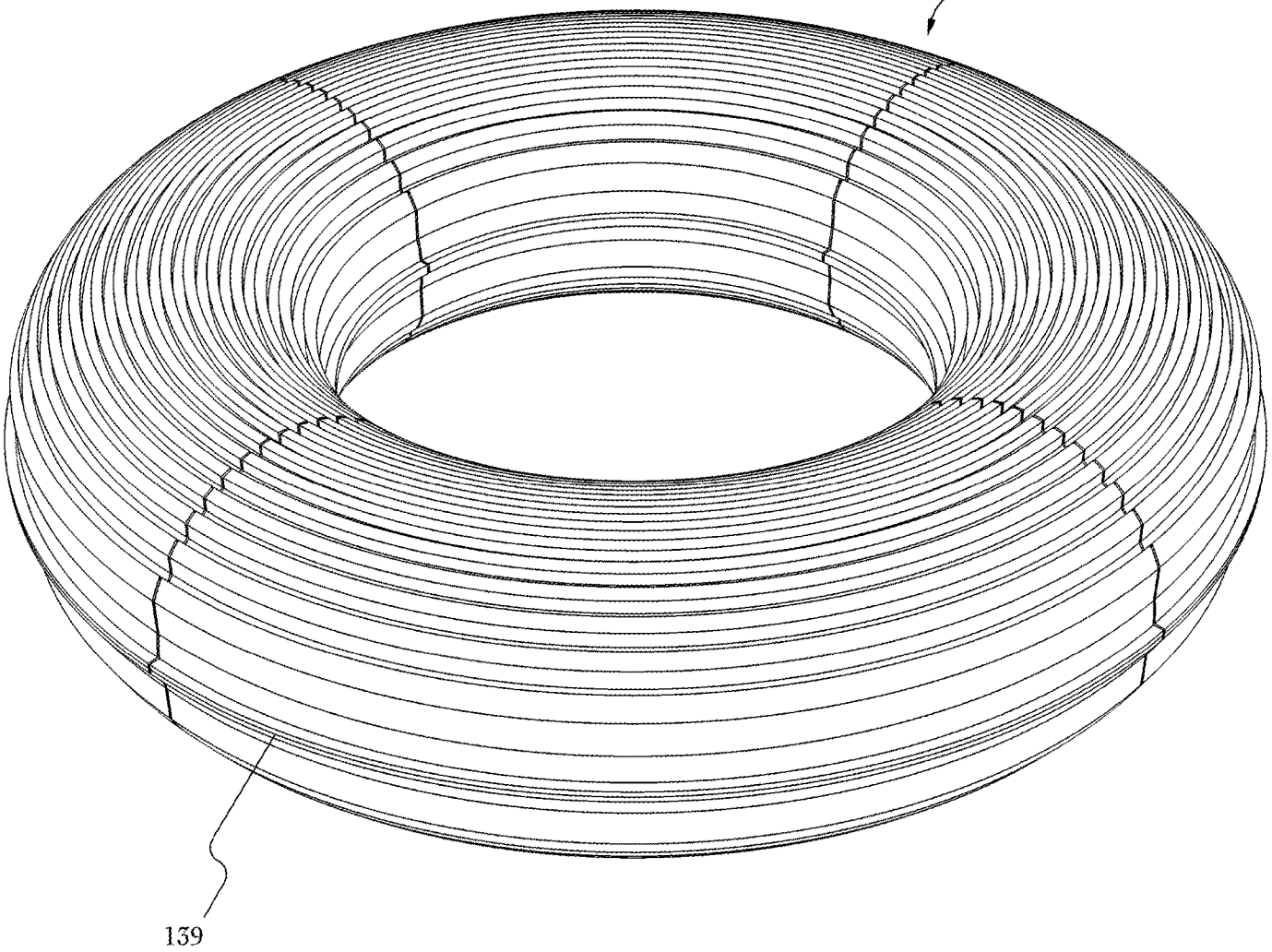
FIG. 4*e* is a perspective view of the core of a toroidal assembly, according to an embodiment of the present invention.
Figure 4F:
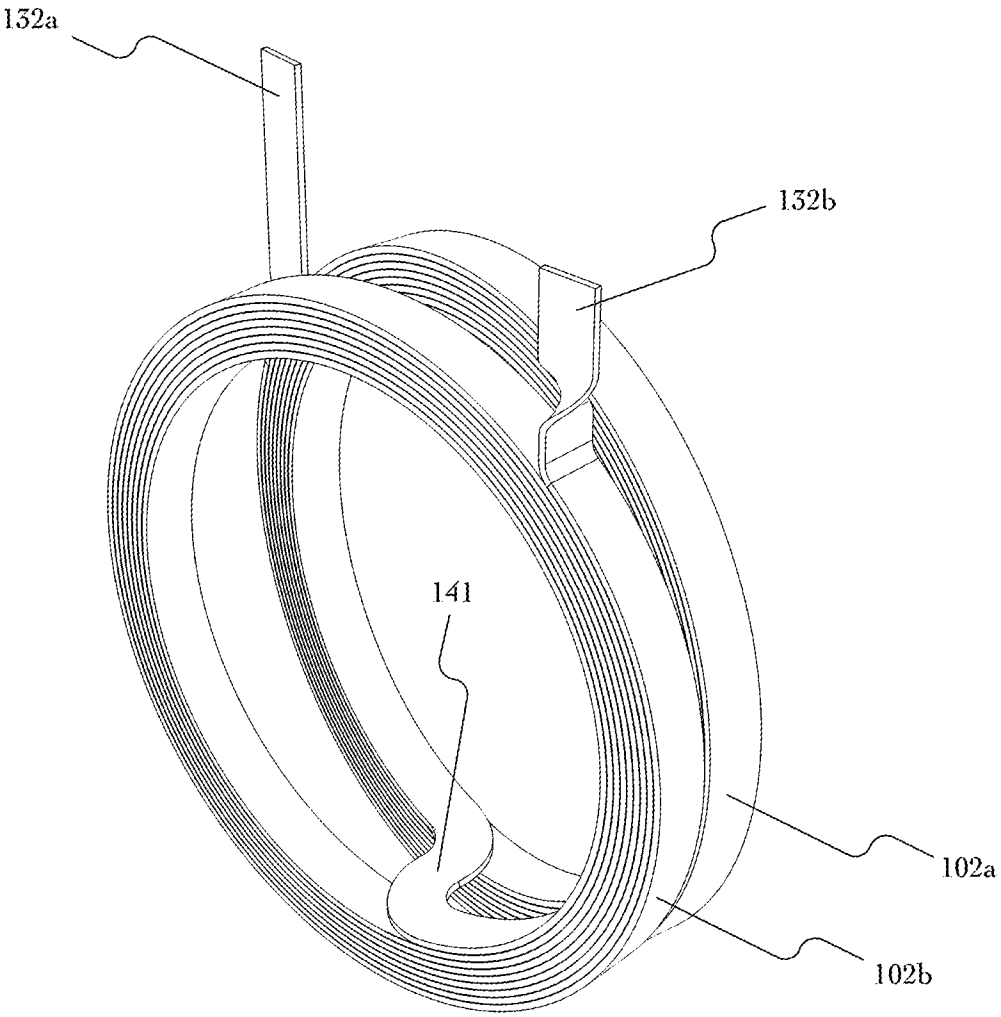
FIG. 4*f* is a perspective view of a coil pair of a toroidal assembly, according to an embodiment of the present invention.
Figure 4G:
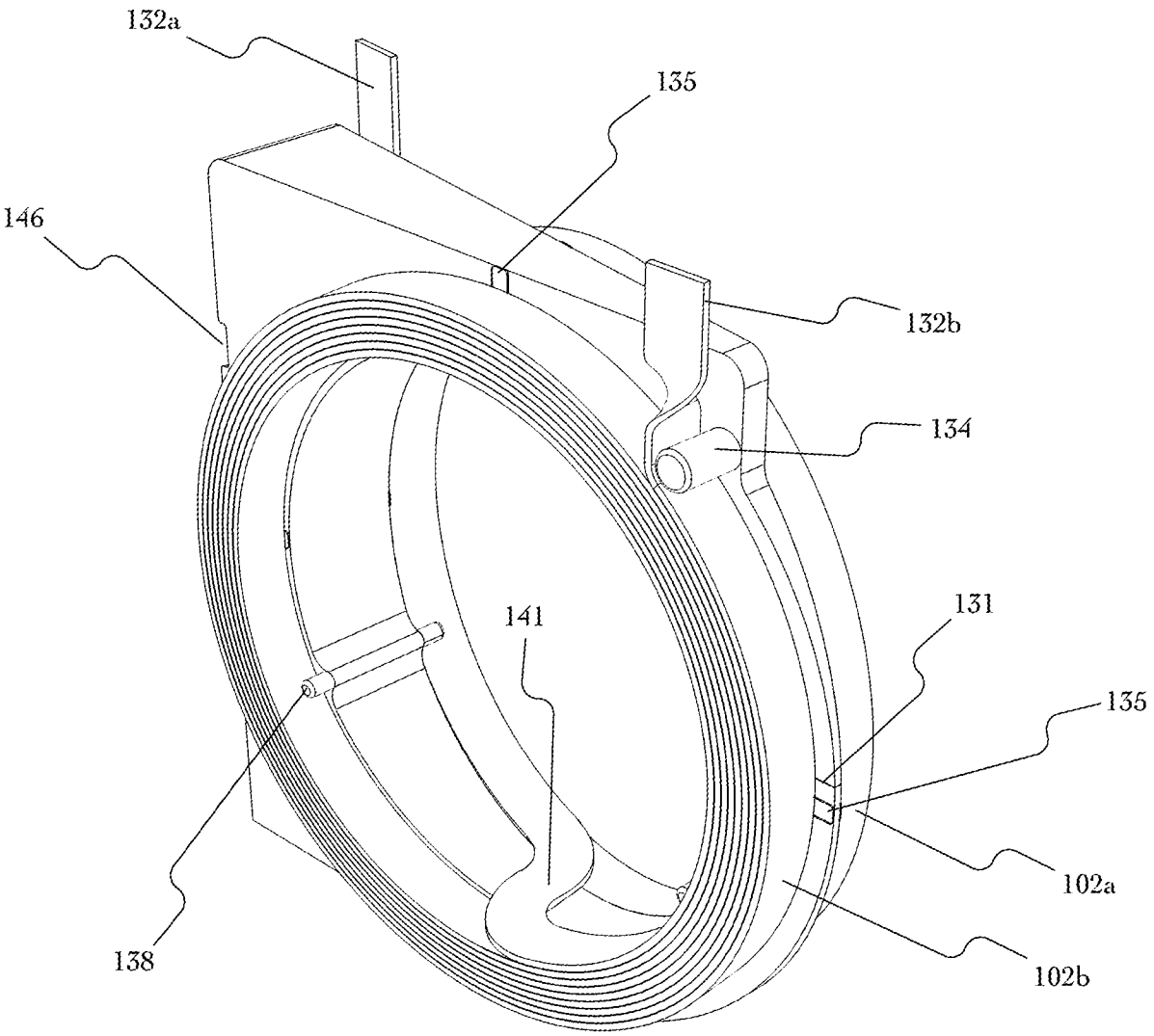
FIG. 4*g* is a perspective view of a coil pair—active wedge assembly of a toroidal assembly, according to an embodiment of the present invention.
Figure 7:
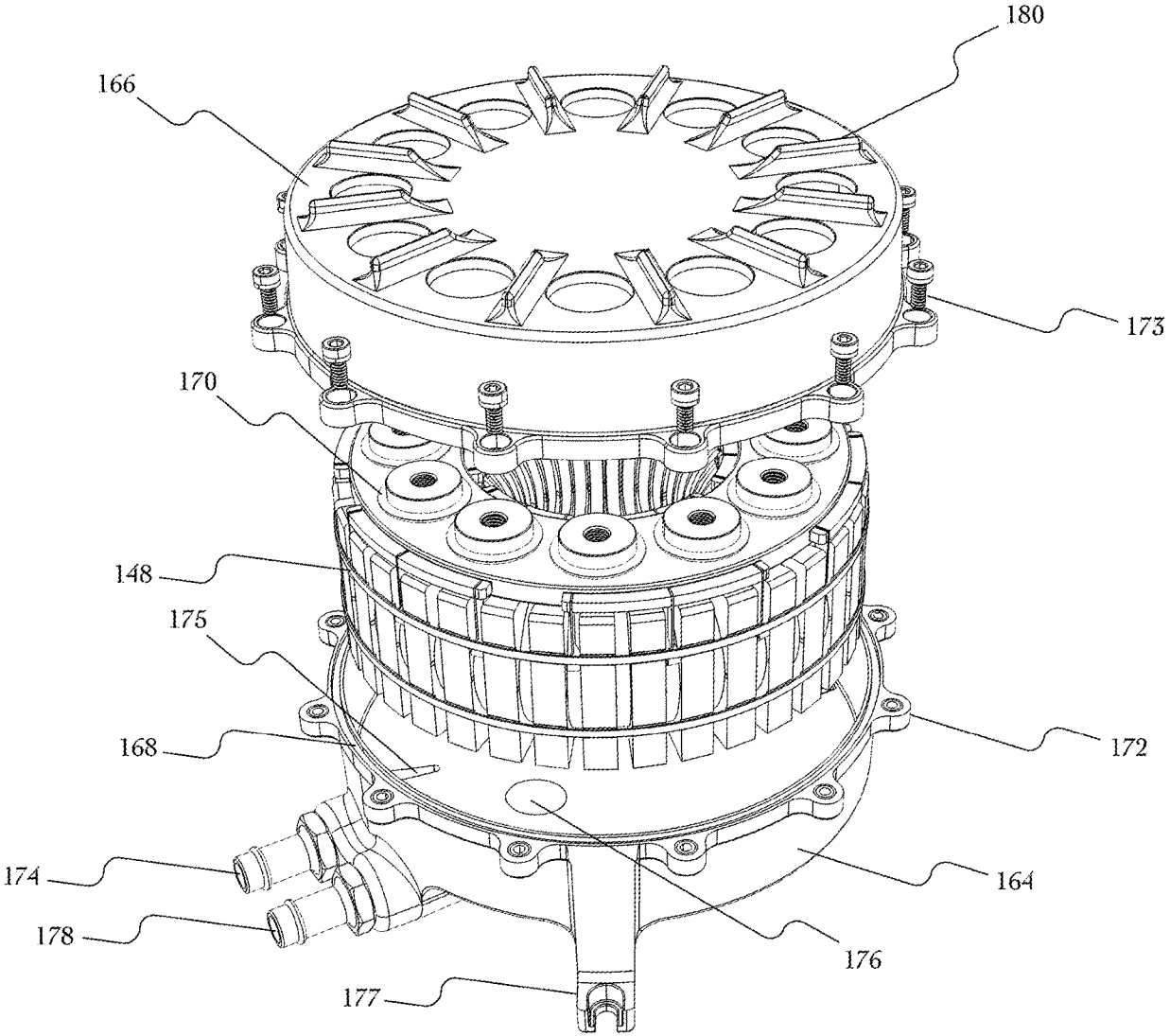
FIG. 7 is an exploded perspective view of a fluid cooled magnetic element, according to an embodiment of the present invention.

A plurality of ribs 135 is present on each of the two wedge faces 136. Each rib 135 may protrude a distance h above the face on which it is located, with h equal to the width g of the toroidal gap 126 between the annular surface of the coil 102 and the wedge face 136 (FIG. 3), so that when a coil 102 is installed so that one of its annular surfaces abuts the ribs 135, the toroidal gap 126 has a width g (except at the ribs 135). As such, each of the ribs may operate as a gap-setting feature. Coolant may flow through this toroidal gap 126, making direct contact with the wire insulation, and the thermal resistance between the conductor of the coil and the coolant may be relatively small. The length of the thermal path between the conductor of each turn of each coil and the coolant may include a relatively long distance within the conductor (which may, however, be a good conductor of heat) and a portion through the wire insulation. The wire insulation may be a relatively poor conductor of heat, but the length of the thermal path through the insulation may equal the thickness of the insulation, i.e., it may be quite small. Each of the ribs 135 may protrude above the wedge face by, e.g., 0.004 inches, so that the width g of the gap 126 is 0.004 inches. In some embodiments ribs are formed on the annular surfaces of the coils instead of, or in addition to, the ribs 135 on the wedges. Ribs may be formed on the coils using strips of tape (e.g., adhesive tape), or strips of another suitable shim material, for example. Each of the wedges 104, 105 may have a plurality of coil centering tigs 138 that fit inside the bore of each coil 102 to align coils 102 with the core and the other coils. In some embodiments the tigs 138 are used primarily for assembly, and after assembly the coils are held in place by compressive forces (e.g., forces generated by a compression band 148 (FIG. 7), described in further detail below). In other embodiments another method is used to maintain alignment during assembly, e.g., an adhesive (that will not contaminate the coolant) may be used. Three coil support projections 140 may extend into the aperture of each wedge 104, 105 to support the core segments 118 within the aperture. Each of the wedges 104, 105 may include one or more registers 146 for a compression band 148 (FIG. 7) that extends around an outer perimeter of the toroidal assembly and applies an inward force to each of the wedges 104, 105, to maintain a compressive force on all of the coils 102 and wedges 104, 105. One of the wedges 104, 105, which may be referred to as a "ducted wedge", includes an inlet hole 122 providing a fluid path into the first radial gap 124. FIGS. 4*c* and 4*d* show the inlet hole 122 in a passive wedge 105; in other embodiments it is instead in an active wedge 104, or several wedges (e.g., all of the wedges) may include inlet holes 122, some of which (or all but one of which) may be unused. As shown in FIGS. 4*c* and 4*d*, sealing flange 137 is added to the base of a ducted wedge; this feature is included to provide a fluid seal between the ducted wedge and the enclosure bottom (FIG. 7). FIG. 4*e* shows core 118. Core fins 139 may be added to the surface of core 118 to enhance heat transfer between the core and coolant which flows in contact with the core. While core 118 is shown as four segments, different numbers of core segments may be used. FIG. 4*f* provides detail for coils 102. As shown, coils 102*a* and 102*b* connect together at the I.D. via S-Bend 141 to provide a dual coil assembly. Coil ends 132*a* and 132*b* may include 90 degree twists, as shown, such that the coil ends are properly orientated for mating with terminal buses. FIG. 4*g* shows an active wedge 104 with the dual coil installed. As shown, coils 102*a* and 102*b* are formed from a single conductor which includes S-Bend 141.

Figure 5:
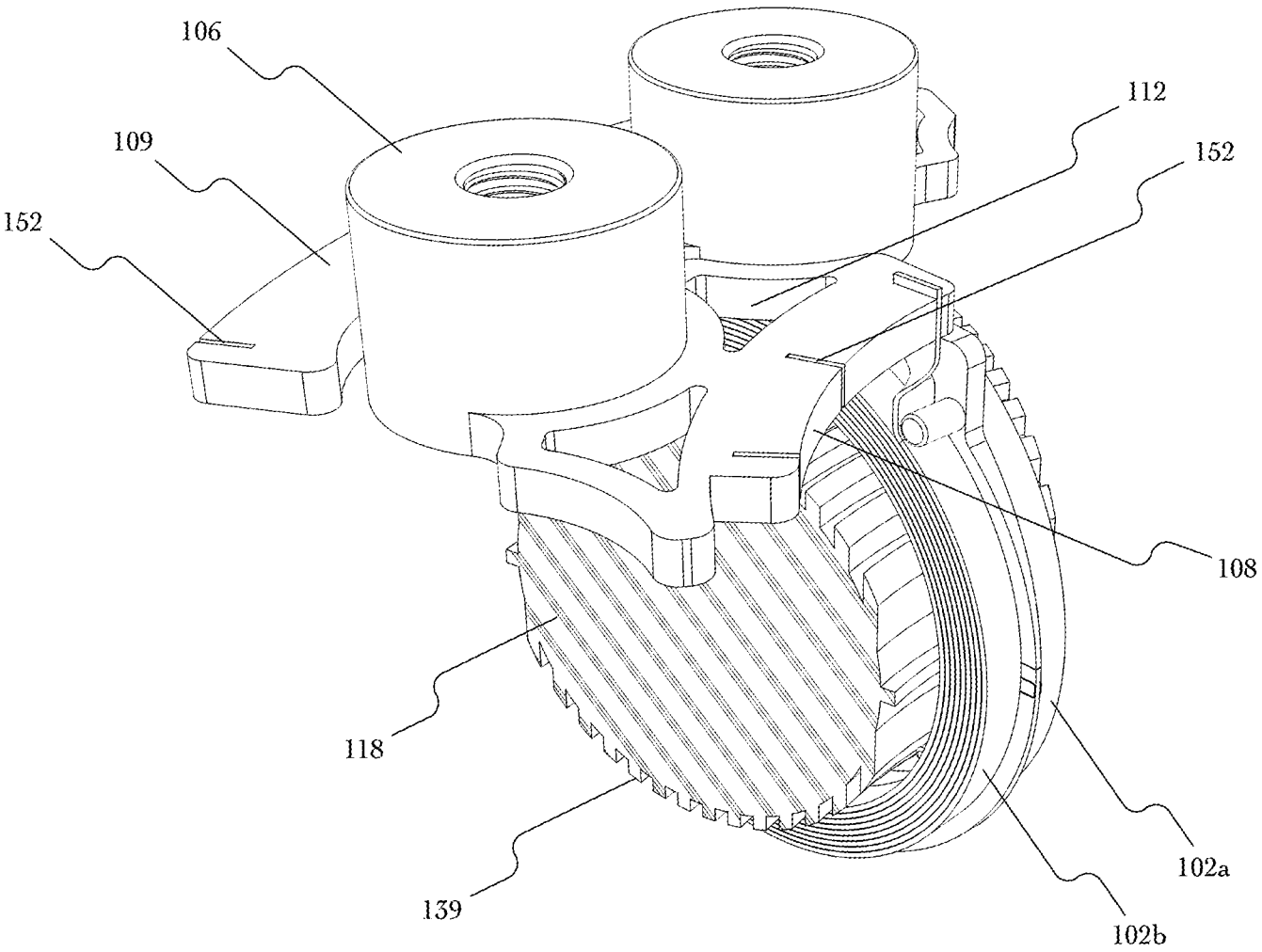
FIG. 5 is a perspective view of a portion of a toroidal assembly, according to an embodiment of the present invention.

Referring to FIG. 5, in some embodiments, each of the terminals 106 is connected either to an inner bus bar 108 or an outer bus bar 109. Each of the bus bars 108, 109 has one or more bus bar slots 152 that are used to secure (e.g., by soldering or welding) respective outer ends 132 of coils 102 to the bus bars 108, 109. In the embodiment of FIG. 5, each pair of bus bars 108, 109 connects three windings together in parallel, each winding including two coils 102 connected in series.

Figure 6:
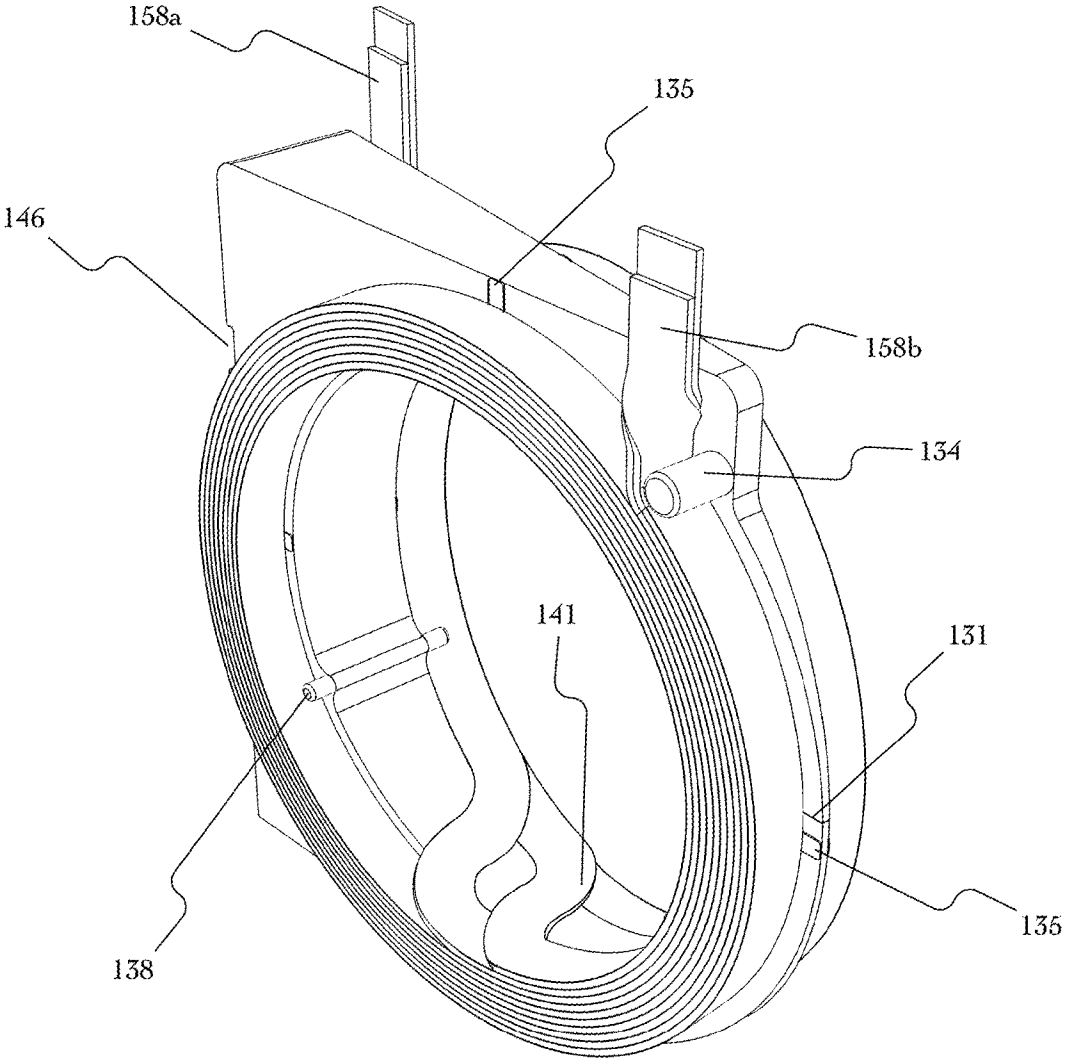
FIG. 6 is a perspective view of a n-co wound conductor coil pair—active wedge assembly of a toroidal assembly, according to an embodiment of the present invention.

Numerous variations on the embodiments described are possible, as will be apparent to one of skill in the art. For example, referring to FIG. 6, in some embodiments, composite coils 154*a*, 154*b* are used instead of simple coils 102. Each of the composite coils 154*a*, 154*b* includes two co-wound, face-wound, rectangular wires as shown. The two composite coils connect at the I.D. via S-Bends 141*a* and 141*b*. As is the case in the embodiment illustrated, e.g., in FIGS. 2 and 5, the two composite coils 154*a*, 154*b* are installed in different winding orientations on two respective faces of the active wedge 104, so that, for example, current may flow clockwise (as seen in view of FIG. 6) from the outer ends to the inner ends of the first composite coil 154*a*, then through the two S-Bends 141*a* and 141*b* and then clockwise again, from the inner ends to the outer ends of the second composite coil 154*b*. In this arrangement the magnetic field contributions produced by the two composite coils 154*a*, 154*b* are in the same direction (i.e., not in opposite directions) along the central axis of the two composite coils 154*a*, 154*b*. In other embodiments, composite coils each including more than two co-wound conductors (e.g., using three, four, five or more co-wound conductors) may be used. Losses due to the proximity effect and losses due to the skin effect may both be reduced by such an approach. For example, in the embodiment of FIG. 6, the conductor that is on the inside of the first composite coil 154*a* is connected, by one of the connection pins 128, to the conductor that is on the outside of the second composite coil 154*b*. More generally in an embodiment with n co-wound conductors in each composite coil (n being a positive integer), the $j^{th}$ conductor (e.g., counting outwards from the innermost conductor) from a composite coil on one side of an active wedge 104 may be connected to the $(n-j+1)^{th}$ conductor (counting in the same manner, e.g., outwards from the innermost conductor) of the composite coil on the other side of the active wedge 104. This connection provides a transposition that may result in a reduction of proximity losses, for example, by a factor of nearly 4 (or a factor of nearly $n^2$ when n co-wound conductors are used).

FIG. 7 shows an exploded view of a fluid-cooled magnetic element according to one embodiment. The toroidal assembly 101 is enclosed in a housing including enclosure bottom 164 and enclosure top 166, sealed together with a housing O-ring 168. A seal may be formed around each terminal by a respective terminal O-ring 170. Enclosure bottom 164 and enclosure top 166 may be secured together at a plurality of housing ears 172 by threaded fasteners 173. Enclosure bottom 164 and enclosure top 166 may be composed of an insulator (e.g., a polymer) or of a metal; if a metal is used, insulting bushings may be used around the terminals 106 to insulate them from the enclosure top 166. Mounting brackets 177 may be used to secure the fluid-cooled magnetic element to a suitable mounting surface. Fluid may flow into the fluid-cooled magnetic element through a fluid inlet 174 (connected, through an inlet hole 175 on the inner surface of the lower half 164, and through inlet hole 122 of one of the wedges 104, 105, to the first radial gap 124), and it may flow out of the center 127 of the toroidal assembly 101 (after having flowed through the toroidal gaps 126, cooling the coils 102), through an outlet hole 176 on the inner surface of enclosure bottom 164 and through a fluid outlet 178. Enclosure top 166 may include insulator separators 180 to increase the creepage distance between adjacent terminals 106.

In some embodiments, the interior round surface of enclosure bottom 164 is not cylindrical but has a slight taper (which may also function as draft facilitating removal of enclosure bottom 164 from a mold during fabrication) and, instead of a band fitting into a register 146 and being tightened to compress the elements of the toroidal assembly 101, a the compression band 148 may be a circumferential shim that may be pressed into the tapered gap between the wedges 104, 105 and enclosure bottom 164, to similar effect. In other embodiments this operation is performed using enclosure top 166 instead of enclosure bottom 164. The band 148 illustrated in FIG. 7 may be either a compression band that is secured tightly around the wedges 104, 105 (without being aligned within registers 146) or it may be circumferential shim; the two embodiments may be similar in appearance. Although the fluid paths described herein involve fluid flow in one direction e.g., radially outward through the toroidal gaps 126, in other embodiments the fluid may flow in the opposite direction, to similar effect, although the housing may be subjected to greater hydrostatic forces if fluid is pumped into the fluid outlet 178 instead of the fluid inlet 174.

As used herein, the word "or" is inclusive, so that, for example, "A or B" means any one of (i) A, (ii) B, and (iii) A and B. Although exemplary embodiments of a fluid-cooled magnetic element have been specifically described and illustrated herein, many modifications and variations will be apparent to those skilled in the art. Accordingly, it is to be understood that a fluid-cooled magnetic element constructed according to principles of this invention may be embodied other than as specifically described herein. The invention is also defined in the following claims, and equivalents thereof.

What is claimed is:

1. A magnetic element, comprising:

a first electrically conductive coil, having a first annular surface and a second annular surface;

a second electrically conductive coil, having a first annular surface and a second annular surface;

a spacer, the spacer being electrically insulating and having a first face and a second face, the first face being separated from the first annular surface of the first electrically conductive coil by a first gap, the first face not being parallel to the second face;

a gap-setting feature between the spacer and the first electrically conductive coil, configured to set the width of the first gap;

a fluid inlet; and a fluid outlet, wherein:

a fluid path extends from the fluid inlet to the fluid outlet through the first gap, and the magnetic element is configured to cause fluid to flow from an inner volume of the first electrically conductive coil through the first gap to an outer volume of the first electrically conductive coil, or from the outer volume of the first electrically conductive coil through the first gap to the inner volume of the first electrically conductive coil.

2. The magnetic element of claim 1, wherein the first electrically conductive coil is a hollow cylindrical coil.

3. The magnetic element of claim 2, wherein:

the second electrically conductive coil is a hollow cylindrical coil, and the first annular surface of the second electrically conductive coil forms a second gap with the second face of the spacer.

4. The magnetic element of claim 3, wherein the first electrically conductive coil has an outer end and an inner end, and the second electrically conductive coil has an outer end and an inner end connected to the inner end of the first electrically conductive coil, and wherein a contribution to a magnetic field at the center of the first electrically conductive coil, from a current flowing through both coils in series, is in the same direction as a contribution to the magnetic field from the current flowing through the second electrically conductive coil.

5. The magnetic element of claim 1, comprising a plurality of pairs of coils including the first electrically conductive coil and the second electrically conductive coil, wherein the spacer is a wedge.

6. The magnetic element of claim 5, comprising:

a plurality of active wedges including the wedge; and a plurality of passive wedges, each of the active wedges having two faces and being between the two coils of a respective pair of coils, one coil of the pair of coils being on one of the faces, and the other coil of the pair of coils being on the other face, and each of the passive wedges being between a coil of one pair of coils and a coil of another pair of coils.

7. The magnetic element of claim 1, wherein the spacer is ducted and has a fluid passage extending from outside the spacer to an inner volume of the spacer.

8. The magnetic element of claim 1, further comprising a plurality of core segments.

9. The magnetic element of claim 8, wherein a core segment, of the plurality of core segments, is ferromagnetic.

10. The magnetic element of claim 9, wherein the fluid path further extends through a third gap, the third gap being a radial gap between the core segment and the first electrically conductive coil and/or the spacer.

11. The magnetic element of claim 1, wherein the spacer is a wedge.

12. The magnetic element of claim 1, wherein the first gap has a width greater than 0.001 inches and less than 0.02 inches.

13. The magnetic element of claim 1, wherein the first electrically conductive coil is a composite coil including n co-wound conductors.

14. The magnetic element of claim 13 wherein:

the first electrically conductive coil has n inner ends the second electrically conductive coil is a composite coil including n co-wound conductors having n inner ends, a $j^{th}$ inner end of the first electrically conductive coil is connected to an $(n-^{j+1})^{th}$ inner end of the second electrically conductive coil, and n and j are positive integers.

15. The magnetic element of claim 1, comprising a composite winding including the first electrically conductive coil and the second electrically conductive coil.

16. The magnetic element of claim 15, further comprising a third electrically conductive coil, the first electrically conductive coil, the second electrically conductive coil, and the third electrically conductive coil being connected together by a first monolithic conductor.

17. The magnetic element of claim 16, wherein:

a fourth electrically conductive coil is connected to a second monolithic conductor, and the first monolithic conductor is part of a first layer in a layered structure and the second monolithic conductor is part of a second layer in the layered structure.

18. The magnetic element of claim 1, comprising:

a plurality of coils including the first electrically conductive coil and the second electrically conductive coil; and a plurality of spacers including the spacer, the magnetic element having a plurality of gaps including the first gap, each of the gaps being between an annular surface of one of the coils and a face of a respective spacer, wherein the magnetic element is configured to receive fluid flowing into the fluid inlet and to cause most of the fluid to flow through the gaps and out through the fluid outlet.

19. The magnetic element of claim 1, wherein the gap-setting feature is a protrusion on:

the first face of the spacer, and/or the first electrically conductive coil.

20. The magnetic element of claim 1, wherein the first electrically conductive coil is formed of a rectangular conductor wound in the manner of a roll of tape.

21. The magnetic element of claim 1, further comprising a housing configured to prevent the escape of fluid.

22. The magnetic element of claim 10, wherein a surface of the core segment has a plurality of core fins.

23. A toroidal magnetic element, comprising:

a first electrically conductive coil, having a first annular surface and a second annular surface;

a second electrically conductive coil, having a first annular surface and a second annular surface;

a spacer, the spacer being electrically insulating and having a first face and a second face, the first face being separated from the first annular surface of the first electrically conductive coil by a first gap, the first face not being parallel to the second face;

a gap-setting feature between the spacer and the first electrically conductive coil, configured to set the width of the first gap;

a fluid inlet; and a fluid outlet, wherein:

the toroidal magnetic element comprises a plurality of coils including the first electrically conductive coil and the second electrically conductive coil, a fluid path extends from the fluid inlet to the fluid outlet through the first gap, and the coils of the plurality of coils are arranged to form a torus.

24. The toroidal magnetic element of claim 23, wherein:

the respective winding orientations of the coils alternate around at least a portion of the torus such that the winding direction of adjacent coils is opposite; and a first inner end of each of the plurality of coils is connected to a first inner end of a respective adjacent coil of the plurality of coils.

* * * * *